United States Patent [19]

Zimmerman

[11] Patent Number: 4,612,154

[45] Date of Patent: Sep. 16, 1986

[54] SPINNING OF CERTAIN HIGH MOLECULAR WEIGHT ANISOTROPIC MELT FORMING POLYESTERS

[75] Inventor: Joseph Zimmerman, Greenville, Del.

[73] Assignee: E. I. Du Pont de Nemours and Company, Wilmington, Del.

[21] Appl. No.: 621,192

[22] Filed: Jun. 15, 1984

[51] Int. Cl.[4] ..... D01D 5/10; C08G 63/18

[52] U.S. Cl. ..... 264/176.2; 528/190; 528/191

[58] Field of Search ..... 264/176 F; 528/190, 528/191

[56] References Cited

U.S. PATENT DOCUMENTS

| | | | |
|---|---|---|---|
| 4,066,620 | 1/1978 | Kleinschuster et al. | 264/176 F |
| 4,075,262 | 2/1978 | Schaefgen | 525/444 |
| 4,118,372 | 10/1978 | Schaefgen | 528/190 |
| 4,161,470 | 7/1979 | Calundann | 524/599 |
| 4,183,895 | 1/1980 | Luise | 264/176 F |
| 4,230,817 | 10/1980 | Charbonneau | 528/206 |
| 4,325,903 | 4/1982 | Wissbrun et al. | 264/176 R |
| 4,346,208 | 8/1982 | Fayolle | 528/176 |
| 4,370,466 | 1/1983 | Siemionko | 528/190 |

FOREIGN PATENT DOCUMENTS

| | | | |
|---|---|---|---|
| 0001185 | 3/1979 | European Pat. Off. | 264/176 F |

*Primary Examiner*—Donald Czaja
*Assistant Examiner*—Hubert C. Lorin

[57] ABSTRACT

High molecular weight anisotropic melt-forming polyesters are melted and then spun below the melting point through spinneret orifices of less than about 25 mils in diameter to reduce nonuniformity in resulting filaments.

3 Claims, 2 Drawing Figures

SPINNING OF CERTAIN HIGH MOLECULAR WEIGHT ANISOTROPIC MELT FORMING POLYESTERS

BACKGROUND OF THE INVENTION

Fully aromatic polyesters characterized by formation of anisotropic melts have been disclosed in a number of patents. These are generally spun at moderate molecular weight to form oriented fibers of low to moderate tensile strength. Subsequently, these as-spun fibers can be subjected to heat-treatment over fairly long periods of time as a result of which they increase in molecular weight and strengthen significantly but there is expense associated with such heat-treatment. When attempts are made to spin higher strength fibers directly from higher molecular weight polymers of this class of compositions, poor properties and excessive diameter fluctuations along the length of the filaments are encountered. By use of certain techniques, this invention permits spinning of a specified class of anisotropic melt-forming polyesters of higher molecular weight with consistent attainment of uniform higher strength fibers than have been previously attainable from such high molecular weight polymers.

THE FIGURES

FIG. 1 and FIG. 2 each represents curves obtained by a Differential Scanning Calorimeter. The axis are Heat Flow in milliwatts (mW) and Temperature in degrees Centigrade (°C.).

SUMMARY OF THE INVENTION

This invention involves (1) selecting an aromatic polyester which forms an anisotropic melt and has a melting point below about 335° C. and a heat of crystallization ($\Delta H_c$), of $\leqq$10 Joules/g (J/g) preferably less than about 6 J/g. all as obtained from heating and cooling curves in a Differential Scanning Calorimeter (DSC) and having a molecular weight sufficiently high so as to cause pulsations when spun above the melting point; (2) melting and maintaining the polymer at a temperature at least about 10° C. above its melting point and (3) spinning the polymer through a spinneret orifice of about 25 mils or less in diameter at a spinneret temperature of at least 240° C. and above the freezing point but below the melting point. When the DSC curve contains multiple melting endothermic peaks, the temperature at the last major peak is considered the melting point.

DETAILED DESCRIPTION OF THE INVENTION

Figure 1:
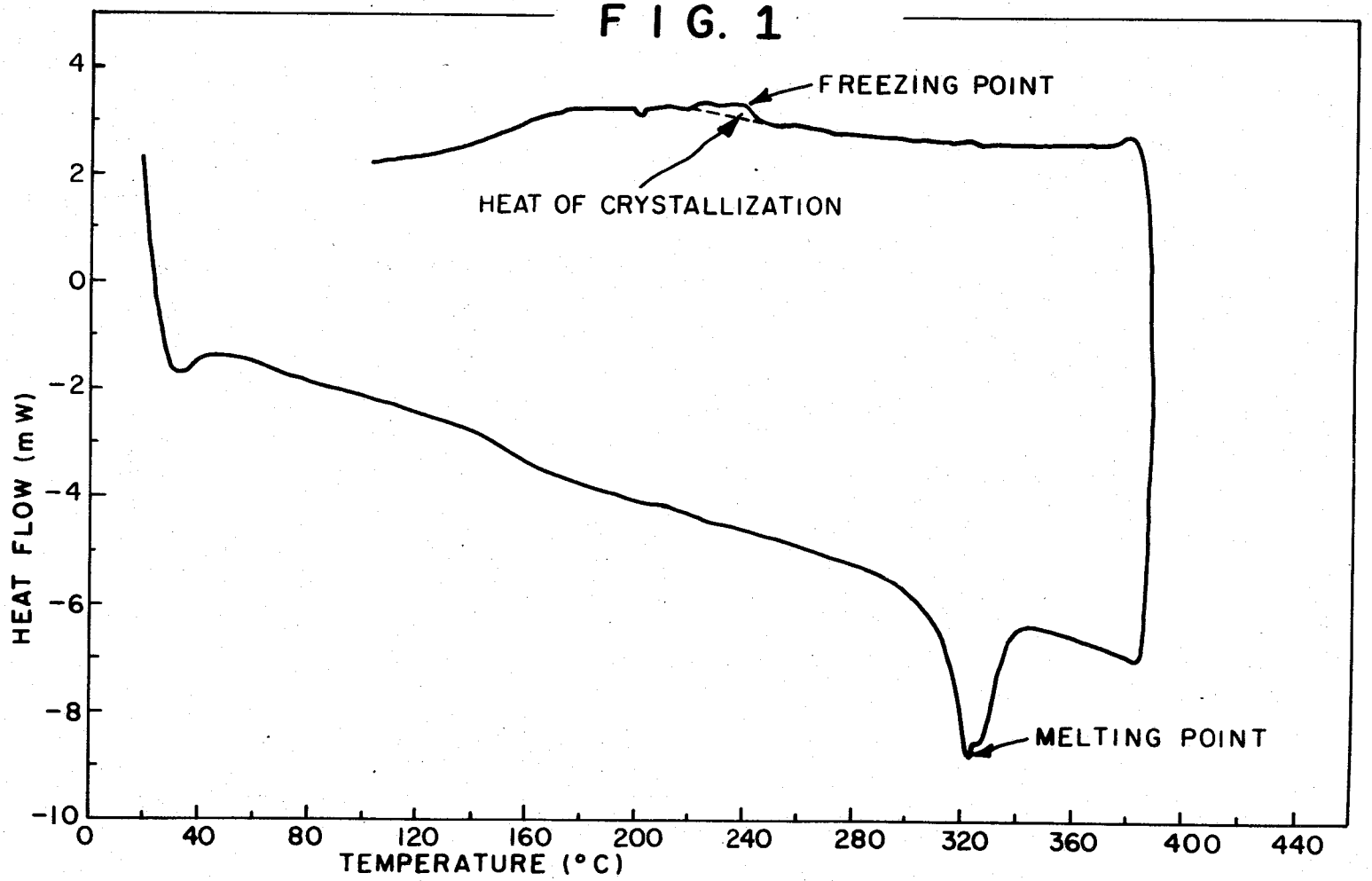

When conventional spinning temperatures (i.e., above the melting point) are used, high $\eta_{inh}$ anisotropic melt-forming polyesters generally spin poorly in that the spinning threadline shows only a slow rate of neck-down in the first few millimeters, e.g., 5–10 mm, from the spinneret and then necks down rapidly with pulsations which yield thick-and-thin fibers. The strengths of such fibers are generally lower than those of yarns of lower $\eta_{inh}$ such as are disclosed in the prior art. Heat-strengthening cannot overcome deficiencies caused by their diameter nonuniformity along the threadline. This type of pulsating spinning behavior may be considered as a form of "draw resonance". The relatively thick sections of the solidified fiber have low luster. With the present invention the delustered portion of the threadline is substantially eliminated, pulsations cease and lustrous fibers can be collected with high orientation and tensile strength.

The polymers whose spinning is improved by the present invention are from a particular chemical class, have a defined molecular weight as determined by inherent viscosity, have a melting point below about 335° C. and a $\Delta H_c$ of 10 Joules/g or less.

1. Chemical Nature of the Polymers

The polymers are selected from the class of anisotropic melt-forming fully aromatic polyesters wherein the polyester chain extending bonds of single or fused aromatic carbocyclic rings are positioned 1,4 to each other if attached to the same ring, or parallel and oppositely directed if on different rings. In multiple ring systems in which the individual rings are joined, either directly or indirectly, the chain extending bonds are parallel and oppositely directed. Small amounts, e.g., up to 3 mol % of repeating units which do not conform to this description such as isophthaloyl units may be present without interfering with the process.

2. Molecular Weight

The present invention solves a problem encountered in melt-spinning certain high molecular weight polyesters. This problem may be described as pulsating spinning resulting in thick and thin sections along the fiber length. Thus the invention is of advantage with polyesters having a molecular weight sufficiently high so as to cause pulsations during melt-spinning. For most polymers the level at which the problem occurs is at an inherent viscosity, $\eta_{inh}$, of at least 2.5 measured as described below.

3. DSC Curves

The Figures represent the curves obtained by a Differential Scanning Calorimeter (Du Pont 1090) with a 20°/min heating rate and 10° C./min cooling rate for the polymers of Examples I and II below. Indicated in the Figures is the melting point, the freezing point and the heat of crystallization. The polymer melting point, i.e., the temperature at the last major peak, should not exceed 335° C. It corresponds to the lowest temperature required to fully melt the polymer. The freezing point corresponds to the highest temperature at which the molten polymer solidifies. The heat of crystallization is determined directly from the DSC.

4. Polymer Preparation

The polymers are prepared by well-known procedures (see U.S. Pat. No. 4,118,372) in which, for example, the diacetates of the diols are reacted with the desired diacids and, if appropriate, the acetate of an aromatic hydroxy acid, if used as a copolymer component. Initially it is customary to operate at atmospheric pressure or with a slight vacuum in an oxygen-free atmosphere and then under gradually reducing pressure (e.g., down to 5 mm Hg or less) until the inherent viscosity (measured in a 0.5% solution) is 0.5 or higher. The polymer is then isolated and pulverized and subjected to solid phase polymerization (SPP). It is generally preferable to reach final SPP temperatures gradually to permit crystallization and some polymerization to occur at lower temperatures which then reduces sticking propensity at the higher temperatures. Alternatively, the polymer can be polymerized to high $\eta_{inh}$ in a suitable melt polymerizer.

5. Spinning

The high $\eta_{inh}$ polymer having a suitably low heat of crystallization is melted thoroughly and maintained at temperatures at least about 10° C. and generally not more than 35° C. above the melting point and forwarded to a spinneret whose temperature is at least 240° C. and above the DSC freezing point but below the melting point.

The size of the spinneret orifice is important. If the diameter of the orifice materially exceeds 25 mils, it has been found that pulsations in spinning are not avoided. On the other hand, the degree of cooling required for maximum fiber strength can be minimized by reducing the spinneret orifice diameter to 6 mils or less.

If desired, the fibers obtained in accordance with this invention may be strengthened further by heat treatment in ways well-known to the art.

MEASUREMENTS

Inherent viscosity ($\eta_{inh}$) is determined at a concentration of 0.5 grams of polymer in 100 ml of solvent (typically 1,1,1,3,3,3-hexafluoroisopropanol/chloroform (50/50, vol/vol). In those cases, where the polyesters are not readily soluble in this solvent, $\eta_{inh}$ is measured in pentafluorophenol (PFP) at a concentration of 0.1 g of polymer in 100 ml of solvent. Tensile properties are determined in a conventional "Instron" Tensile Tester on 2.5 cm single filaments. DSC curves are obtained in a Du Pont 1090 Differential Scanning Calorimeter with a 20° C./min heating rate and 10° C./min cooling rate.

EXAMPLE I

An aromatic polyester is prepared by combining in a 1000 ml 3-neck, round bottom flask 0.933 mol (253 g) of phenylhydroquinone diacetate (4 mol % excess), 0.900 mol (149.4 g) of terephthalic acid, 0.100 mol (23 g) of 2,6-acetoxynaphthoic acid and 0.079 g of sodium acetate as a catalyst. The flask is equipped with a stirrer, nitrogen inlet port, distillation head and a collection vessel. The reaction vessel is evacuated and purged with nitrogen five times and placed in a Woods metal bath at 310° C. while under a slight vacuum. When most of the mixture is molten (except for some terephthalic acid), the stirrer is turned on at 30 revolutions per minute. After the acetic acid byproduct collects in the receiving flask for about 30 minutes, the temperature is gradually increased to 330° C. and the pressure reduced to 0.15 mm of mercury over a period of about 60 minutes and held for about six minutes at 0.15 mm. Then the vacuum is released, the polymer blanketed with nitrogen and the polymerization flask removed from the heating bath. Polymer $\eta_{inh}$ is about 2.0. The polymer is crushed, ground to a powder and then subjected to solid phase polymerization in a vacuum oven at a pressure of 0.5–0.6 mm of Hg. The oven temperature is increased from 192° C. to about 280° C. over a period of about 9 hours and then maintained at 280° C. for about 21 hours. The polymer ($\eta_{inh}$ 7.2) is then melted and prefiltered through a screen pack at a temperature of 340° C., collected and respun at a melt temperature of about 335° C., and extruded through a 5 mil spinneret whose temperature is maintained at 302° C. Uniform, lustrous fibers are obtained at 47 meters/min wind-up speed with filament (2.5 cm length) tenacity of 14.5 g/d and elongation of 4.9% at a denier of 6.4. Yarn $\eta_{inh}$ is about 5.4. FIG. 1 is a plot of the heating and cooling curves obtained from the DSC indicating the melting and freezing point peaks for the solid phase polymerized polymer. The heat of crystallization, $\Delta H_c$ is determined from the area under the curve. The DSC characteristics of the solid phase polymerized polymer are: melting point, about 323° C., freezing point, about 238° C. and $\Delta H_c$, 2.4 J/g. The polymer composition in mol % of PHQ/T/HNA is 47.4/47.4/5.3, where PHQ is the polymer unit derived from phenylhydroquinone or a precursor thereof, T is the unit derived from terephthalic acid and HNA is the polymer unit derived from 2,6-hydroxy naphthoic acid or a precursor thereof.

EXAMPLE II

Figure 2:
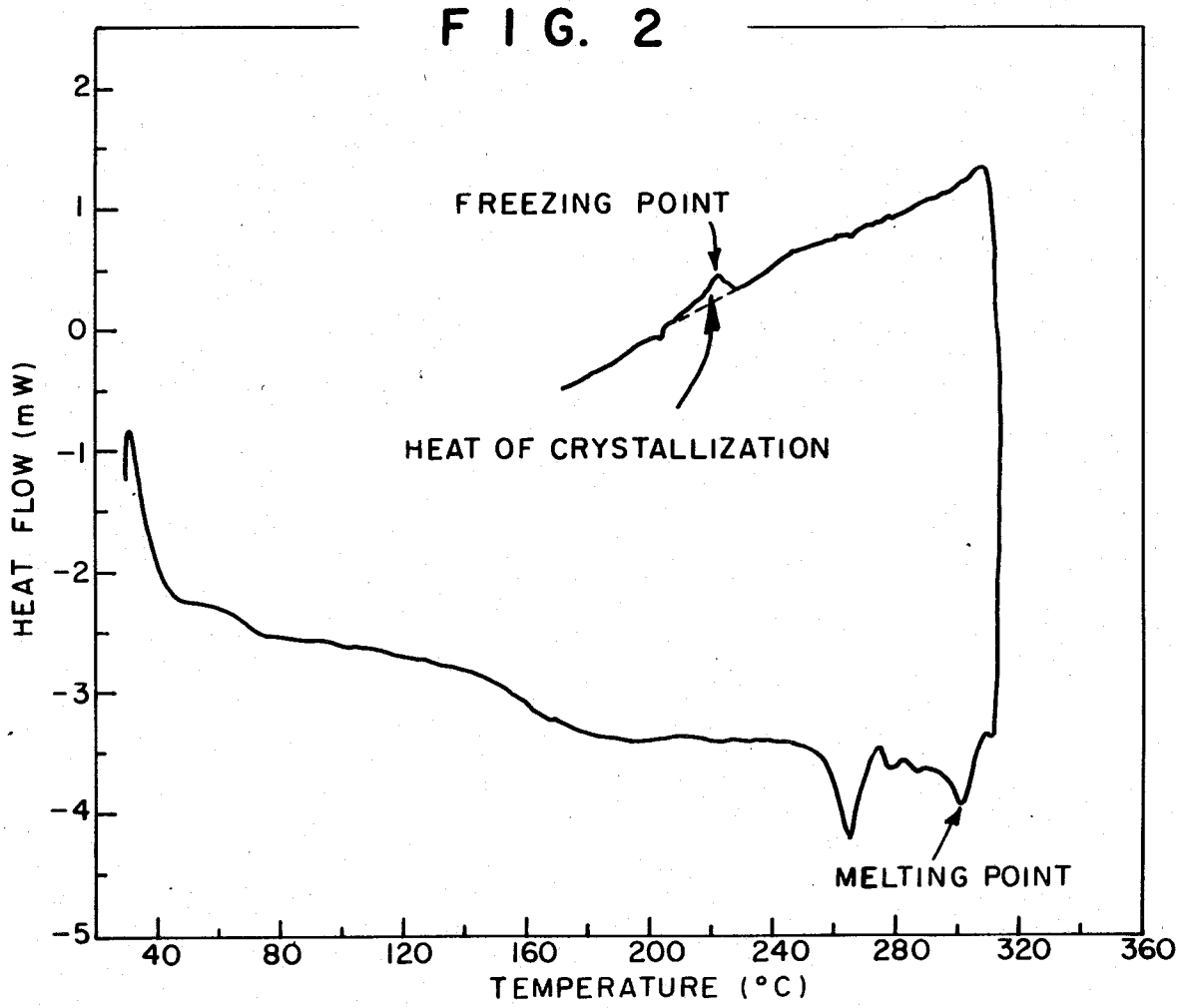

A polymer similar to that of Example I is prepared. Its composition in mol % of PHQ/T/HNA is 46/46/8. The $\eta_{inh}$ of the melt-prepared polymer is about 2.4. This polymer, after being ground, is subjected to solid phase polymerization at a pressure of about 2.0 mm of Hg with a gradually rising temperature over a 9 hour period and held for about 16 hours at 282° C. The polymer ($\eta_{inh}$ 4.0) is melted at 323° C. and spun through a 15 mil spinneret maintained at 282° C. Uniform, lustrous fibers are obtained at 87 meters/min windup speed with 12.5 g/d filament tenacity and 4.6% elongation. Filament denier is 21.4 and fiber $\eta_{inh}$ is 4.6. FIG. 2 is a plot of the heating and cooling curves obtained from the DSC for the solid phase polymerized polymer of this example. The heating curve shows multiple peaks, the last major peak representing the melting point reported herein. The melting point is 301° C. (temperature at the last major peak), the freezing point is at 222° C. and $\Delta H_c$ is 1.6 J/g.

EXAMPLE III

The polymer of Example II is solid phase polymerized for a longer period of time to achieve a higher $\eta_{inh}$. It is melted at 316° C. and spun at 283° C. with a spinneret having a 10 mil diameter capillary. Tenacity of the 35 denier filament wound at 18 m/min is 12.8 g/d at 5.6% elongation. Fiber $\eta_{inh}$ is 6.1. When the spinneret temperature is increased to 302° C., there is marked draw resonance and the resulting thick and thin filaments are very weak.

EXAMPLE IV

A polyester whose composition in mol % of PHQ/T/HNA is 49/49/2 is prepared by melt polymerization to a $\eta_{inh}$ of 1.13 and solid phase polymerized at a pressure of about 1.9 mm of Hg and a temperature of 280° C. The polymer ($\eta_{inh}$ 12.8) is spun with a spinneret having a 5 mil diameter capillary. Melt temperature is 350° C. and the spinneret temperature is 324° C. The 7.9 denier filaments on a bobbin wound at 37 m/min have an average tenacity of 15.6 g/d at 4.2% elongation. Fiber $\eta_{inh}$ is 6.9. DSC characteristics of the polymer are: melting point is about 348° C. freezing point is at about 251° C. and $\Delta H_c$ is about 2.1 J/g.

EXAMPLE V

A polyester is prepared from phenylhydroquinone terephthalic acid, 3,4'-dihydroxybenzophenone and 2,6hydroxy naphthoic acid (starting as usual with the acetates) having a composition in mol % of PHQ/T/DHB/HNA of 42/46/4/8. The symbol DHB represents the polymer unit derived from 3,4'-dihydroxybenzophenone or a precursor thereof. Polymer $\eta_{inh}$ is about 1.1. After solid phase polymerization at 277°C. for about 24 hours (0.6 mm pressure) and melt prefiltration, the polymer ($\eta_{inh}$ 5.7) is melted at 334° C., spun through a 5 mil diameter spinneret capillary maintained at 298° C. and wound up at 37 m/min. Tenacity of the 5.5 denier filaments is 12.9 g/d and elongation is 4.4%.

Fiber $\eta_{inh}$ is 5.0 and the DSC characteristics of the polymer are: melting point, about 315° C., freezing point, about 234° C. and $\Delta H_c$, about 2.4 J/g.

EXAMPLE VI

A polymer whose content in mol % of PHQ/T/DHB is 47.5/50/2.5 is prepared from phenylhydroquinone, 3,4'-dihydroxybenzophenone and terephthalic acid (starting from the diacetates of the diols) with $\eta_{inh}$ of 2.2 and solid phase polymerized at 278° C. max. (2.1 mm pressure). The polymer ($\eta_{inh}$ 3.8) is melted at 345° C. and spun through a 5 mil diameter spinneret capillary maintained at 314° C. The tenacity of the 6.1 denier filaments wound at 27 m/min is 11.7 g/d and elongation is 3.6%. Fiber $\eta_{inh}$ is 3.6 and the DSC characteristics of the polymer are: melting point, 326° C., freezing point, 256° C. and $\Delta H_c$, 7.8 J/g.

EXAMPLE VII

A polyester whose composition in mol % of PHQ/T/I/HNA is 44/47/2.7/6.4 is prepared from phenylhydroquinone, terephthalic acid, isophthalic acid and 2,6-hydroxy naphthoic acid (starting from the diacetates of the diols). Polymer $\eta_{inh}$ is 1.27. After a relatively short solid phase polymerization the polymer ($\eta_{inh}$ 2.9) is melted at 320° C. and spun through a 15 mil diameter spinneret at 241° C. to 246° C. At the lowest temperature, the 37.9 denier filaments wound at 46 m/min have a tensile strength of 9.1 g/d and 3.8% elongation. Fiber $\eta_{inh}$ is about 2.7. The DSC curve of the solid phase polymerized polymer shows multiple peaks in the melting endotherm. The melting point is 290° C. (last major peak), the freezing point is about 266° C. and $\Delta H_c$ is 1.46 J/g. The symbol I represents the polymer unit derived from isophthalic acid.

EXAMPLE VIII

A polyester whose composition in mol % of ClHQ/T/HNA is 42.5/42.5/15 is prepared from chlorohydroquinone (ClHQ), terephthalic acid and 2,6-hydroxynaphthoic acid by melt polymerization from the corresponding acetates and then solid phase polymerized. The polymer ($\eta_{inh}$ 6.9 PFP) is melted at about 330° C. and spun through a 15 mil diameter capillary in a spinneret maintained at 280° C. The 41.3 denier filament wound at 93 m/min has a tensile strength of 10.7 g/d and 3.2% elongation. Fiber $\eta_{inh}$ is about 6.3 measured in a 0.1% solution in pentafluorophenol. The DSC characteristics of the polymer are: melting point, 307° C., freezing point, 235° C. and $\Delta H_c$, 2.9 J/g. When spun at 330° C. spinneret temperature, high $\eta_{inh}$ polymers of this composition yield thick and thin yarns.

EXAMPLE IX

A polyester whose composition in mol % of PHQ/T/DHN is 40/50/10, is prepared by reaction of phenylhydroquinone and 2,6-dihydroxynaphthalene (DHN) with terephthaloyl chloride in o-dichlorobenzene solvent with pyridine used as an acid acceptor. The resulting polymer, having $\eta_{inh}$ of 0.77 in pentafluorophenol at 45° C., is subjected to solid phase polymerization at approximately 270° C. for approximately 51 hrs. at 17" Hg pressure with a small $N_2$ bleed. The polymer ($\eta_{inh}$ 4.4 PFP) is melted at 330° C. and spun through a 5 mil spinneret capillary. When the spinneret temperature is maintained at 330° C., draw resonance is encountered. Upon decreasing the spinneret temperature to 294° C., draw resonance essentially disappears. At 280° C., filaments are wound at 48 ypm with 1" filament tenacity of 6.1 g/d and elongation of 2.4%. DSC characteristics of the solid phase polymerized polymer are: melting point about 297° C., freezing point, about 209° C. and $\Delta H_c$, about 0.7 J/g.

EXAMPLE X

The solid phase polymerized polymer of Example IV is melted at a temperature of 348° C. and spun at a spinneret temperature of 326° C. to a fiber having an $\eta_{inh}$ of 6.7 and a filament tenacity of 13.6 g/d with 4.2% elongation. When the fiber is heat-treated at 290° C. for 7 hours after a warm-up cycle of about the same duration it has a tensile strength of 22.4 g/d with 6.3% elongation. High $\eta_{inh}$ fibers spun at spinneret temperatures which are equal to the melt temperature are thick and thin, and relatively weak and nonuniform and are not amenable to effective heat-strengthening.

EXAMPLE XI

Solid phase polymerized phenylhydroquinone terephthalate homopolymer with about 3.5 $\eta_{inh}$ is melted at 360° C. and spun at 360° C. through a 20 mil diameter spinneret capillary. While some pulsations occur, fiber strength is fairly good (i.e., as high as 12.6 g/d at 2.8% elongation for a 3.8 denier filament). Attempts to reduce pulsations by reducing spinneret temperature result in breakdown because of incipient freezing in the capillary. The DSC characteristics of the homopolymer are: melting point, 341° C., freezing point, 286° C. and $\Delta H_c$, 21 J/g. This example shows that polymers having a strong crystallizing tendency as evidenced by a high $\Delta H_c$ are not suited for the process of this invention.

EXAMPLE XII

A melt polymer similar to that in Example I, having an $\eta_{inh}$ of 1.0 is melt polymerized at 355° C. for 20 min. The polymer, having an $\eta_{inh}$ of 4.6 is melted at about 340° C. and spun through a 9 mil spinneret capillary maintained at 284° C. and wound up at 30 m/min. The 12.0 denier filaments have an average tenacity of 11.4 g/d (¼" filaments). When the spinneret is maintained at 350° C., the spinning process is marked by draw resonance and thick and thin fibers are obtained. The DSC melting point for melt finished polymer of this composition is about 315° C., freezing point is 240° C. while $\Delta H_c$ is 2.8 J/g.

EXAMPLE XIII

A polyester whose composition in mol % of DHB/T/HQ is 47.5/50/2.5 is prepared by reacting the corresponding diacetates of 3,4'-dihydroxybenzophenone and hydroquinone (PG) with terephthalic acid, starting at 288° C. and increasing to about 331° C. during the atmospheric pressure phase of the polymerization. The pressure is then reduced gradually to 0.8 mm of Hg. The polymer, having an $\eta_{inh}$ of 1.08 in pentafluorophenol (0.1%), is subjected to solid phase polymerization at about 260° C. for about two days. This polymer, insoluble in PFP, is then melted at about 345° C. and spun through a 4 mil diameter spinneret capillary. Draw resonance is excessive at a spinneret temperature of 345° C. Spinneret temperature is reduced and draw resonance is objectionable until the temperature reaches ~200° C. At 297° C., fiber is collected at 17 m/min. Average 2.5 cm filament tenacity is 14.5 g/d and break elongation is 5.6. Fiber $\eta_{inh}$ (0.1% in pentafluorophenol) is about 2.0. DSC characteristics of the solid phase polymerized polymer are: melting point, about 300° C. (last major peak in melting endotherm), freezing point, about 280° C. and $\Delta H_c$, 5.4 J/g.

What is claimed is:

1. A melt-spinning process comprising a. selecting an aromatic polyester capable of forming an anisotropic melt, said polyester having a melting point below about 335° C., a heat of crystallization equal to or less than 10 J/g and a molecular weight sufficiently high so as to cause pulsations and result in nonuniform filaments when spun above the melting point, b. melting and maintaining the polymer at a temperature at least 10° C. above its melting point, and c. spinning the polymer through a spinneret orifice of about 25 mils or less in diameter, at a spinneret temperature of at least 240° C. and above the freezing point of the polymer but below its melting point.

2. The process of claim 1 wherein the spinneret orifice is 6 mils or less in diameter.

3. The process of claim 1 wherein the polymer to be spun has an $\eta_{inh}$ of at least 2.5.

* * * * *